US007503409B2

(12) United States Patent
Brookover

(10) Patent No.: US 7,503,409 B2
(45) Date of Patent: Mar. 17, 2009

(54) EARTH DRILLING RIG HAVING ELECTRONICALLY CONTROLLED AIR COMPRESSOR

(75) Inventor: Brian David Brookover, West Chester, PA (US)

(73) Assignee: Schramm, Inc., West Chester, PA (US)

( * ) Notice: Subject to any disclaimer, the term of this patent is extended or adjusted under 35 U.S.C. 154(b) by 333 days.

(21) Appl. No.: 11/410,427

(22) Filed: Apr. 25, 2006

(65) Prior Publication Data

US 2007/0246262 A1 Oct. 25, 2007

(51) Int. Cl.
*E21B 44/06* (2006.01)
*E21B 4/06* (2006.01)

(52) U.S. Cl. ..... 175/135; 175/24; 175/40; 173/3

(58) Field of Classification Search ..... 175/135, 175/170, 24, 38, 40; 173/75, 77, 78, 3
See application file for complete search history.

(56) References Cited

U.S. PATENT DOCUMENTS 4,793,421 A * 12/1988 Jasinski ..... 175/27
5,409,072 A * 4/1995 Enlund et al. ..... 175/71
5,944,122 A * 8/1999 Cheers ..... 175/71
2004/0173379 A1 * 9/2004 Leppanen ..... 175/57

* cited by examiner

*Primary Examiner*—David J Bagnell
*Assistant Examiner*—Robert E Fuller
(74) *Attorney, Agent, or Firm*—Howson & Howson LLP

(57) ABSTRACT

In an earth drilling rig in which an air compressor and one or more hydraulic pumps are driven by the same engine, the intake throttle of the compressor is controlled by an electronic controller having a proportional integral derivative control. The controller minimizes unloading of the compressor, allowing the engine to operate more efficiently, the hydraulic system to provide more consistent power to drilling functions and the volume and pressure of compressed air to be optimized for the drilling conditions encountered. The electronic controller also operates a blowdown valve at the discharge side of an air receiver, and effects various overrides of the control system, for example when air discharge temperature approaches a critical level, or when an overpressure condition is detected.

10 Claims, 6 Drawing Sheets

EARTH DRILLING RIG HAVING ELECTRONICALLY CONTROLLED AIR COMPRESSOR

FIELD OF THE INVENTION

This invention relates to earth drilling, and more particularly to improvements in the control of the air compressor system of a drilling rig.

BACKGROUND OF THE INVENTION

Earth drilling rigs, of the kind used to drill water wells, and for mineral exploration, etc., often incorporate a rotary screw air compressor to provide air for the purpose of flushing cuttings from the borehole. In some cases the compressor is also used to provide compressed air for the operation of a down-the-hole hammer for percussive drilling of hard rock.

Drilling rig air compressors are typically regulated by pneumatic controls adapted from general purpose air compressors of the kind used in construction. An air-actuated throttle valve is provided at the compressor's air inlet to control the flow of air through the intake of the compressor. When the pressure in the compressor's air receiver reaches a preset upper limit, the throttle valve is closed, and the compressor is "unloaded," that is, it effectively stops compressing. When the pressure in the receiver falls below a preset lower limit, the valve opens, and the compressor resumes its operation. Thus, the compressor continually switches between a loaded condition and an unloaded condition, operating in an "on-off" mode. In the closed, or unloaded, position, an orifice in the throttle valve allows a small amount of air to enter the compressor. The throttle valve is "substantially" closed, and the volume of air being compressed is only that necessary to avoid cavitation.

The volume of air delivered by the conventional compressor, that is, the volume flow rate, usually measured in cubic feet per minute (cfm), is fixed when the compressor is loaded, that is, when the compressor intake throttle valve is open. There are no intermediate valve positions. Therefore, when the required air volume is less than the full compressor volume capability, the compressor unloads more frequently.

To be powerful enough for effective drilling, yet compact enough to be moved over public highways from job to job, a drilling rig typically employs a single internal combustion engine to power both the compressor and one or more hydraulic pumps which supply hydraulic fluid for the operation of various hydraulic motors and hydraulic actuating cylinders. The hydraulic motors and cylinders are used for various purposes, including rotation of the drill bit, feeding of the bit into the borehole, lifting the drill pipe, operation of devices used to handle the drilling tools, and performance of other drilling rig functions.

In the course of drilling, the power required from the engine by the hydraulic pumps varies according to the size of the hole being drilled, the formations encountered, the amount of water in the hole, etc. Power for the air compressor also varies according to the amount of air required to flush the hole of cuttings and the amount of air required to operate a down-the-hole hammer, when one is used. The engine, air compressor, hydraulic pumps, and other elements of the drilling rig, interact to determine the quality of the hole and the efficiency with which it is drilled. A large volume of compressed air is required for drilling large diameter boreholes, and increases the drilling penetration rate in the case of smaller diameter boreholes. Therefore, in general, drilling contractors desire an air compressor that produces a large volume of compressed air. However, some geological formations cannot tolerate a large volume of air because it can cause borehole erosion. Borehole erosion is detrimental to borehole quality, and can cause deterioration of the casing-to-earth seal, undermining of the drilling rig outriggers, and total borehole collapse or cave-in. On a conventional drilling rig, with a general purpose air compressor control system, the compressor output cannot be matched to the borehole air flow.

Under certain combinations of conditions, the power requirement may exceed the power available, causing the engine to become overloaded and stall. If the engine stalls, the borehole flushing medium is lost, and the hydraulic power to turn and feed the bit is also lost. This can cause a host of problems in the borehole, such as borehole cave-in, backfill, a stuck bit, etc.

In addition, during drilling, because the power drawn by the compressor increases and decreases as the compressor is continually loaded and unloaded, the engine speed can vary considerably, and the hydraulic power available for drilling functions varies, causing erratic operation of the various hydraulically powered devices. Continual loading and unloading of the compressor also raises the noise level at the operator's station. Moreover, the pneumatic components of the compressor control system are subject to malfunction as a result of frozen condensate and other contamination.

In short, general purpose air compressor controls cannot adjust a compressor which is part of a drilling rig system so as to achieve optimum drilling performance.

BRIEF SUMMARY OF THE INVENTION

The earth drilling rig according to the invention has various hydraulically operated components, such as a drill head for rotating a hollow drill pipe, an elongated, tiltable, mast for supporting the drill head, a hollow drill pipe rotatable by the drill head, and a hoist for moving the drill head longitudinally along the mast. The drilling rig also comprises a hydraulic pump mechanism (which can consist of one or more hydraulic pumps) for supplying hydraulic fluid under pressure to drive one or more of the above-mentioned components. An air receiver, for storing air under pressure, is connected to the drill head for delivery of compressed air to the drill pipe. The components of the drilling rig may also include a pneumatic hammer on the drill pipe adjacent to a bit, the pneumatic hammer being operable by air delivered to the drill pipe from the air receiver.

An air compressor, having an air inlet port and an air outlet port, supplies air, through the outlet port, to the air receiver. An engine, preferably a Diesel engine, drives both the air compressor and the hydraulic pump mechanism.

A valve having a variable aperture is arranged to throttle the flow of air through the inlet port of the compressor, and an actuator, connected to the valve, opens and closes the aperture of the valve. The actuator, which is preferably an electrically, or hydraulically, operated linear or rotary actuator, is at least capable of maintaining each of a plurality of discrete valve apertures between limits of a range of valve apertures, and is preferably capable of setting the valve aperture at any desired position within a continuous range of positions between a fully open position and a substantially fully closed position.

A sensor, responsive to the pressure of air within the air receiver, provides a signal to an electronic controller for operating the actuator. The controller has a manually selectable input for selecting a compressor outlet pressure, and a feedback input, the feedback input being responsive to the sensor. In response to the manually selected input and to the feedback input, the controller controls the valve through the actuator, and thereby maintains the compressor outlet pressure at a level corresponding to the pressure selected through the manually selectable input.

In order to effect smooth operation, the control system preferably employs a proportional-integral-derivative (PID) control to minimize switching of the compressor between an unloaded condition and a loaded condition, and to avoid, or at least minimize, overshoot. The electronic controller comprises a first comparison device, responsive to the manually selectable input and the feedback input, for producing an error signal corresponding to the difference between a manually selected pressure and the pressure of air within the air receiver as sensed by the sensor. A target rate of change generator, responsive to the error signal, generates an output having a predetermined relationship to the magnitude of the error signal. A differentiator, responsive to the sensor, produces a signal proportional to the time rate of change of the air pressure in the receiver. A second comparison device, preferably a proportional-integral-derivative (PID) amplifier, responsive to the output of the target rate of change generator and the signal produced by the differentiator, produces a control output to which the actuator responds.

Preferably, the target rate of change generator produces an output corresponding to a zero rate of change of air pressure when the error signal corresponds to a zero difference between the manually selected pressure and the pressure of air within the air receiver, a non-zero rate of change in a first direction when the manually selected pressure exceeds the pressure of air within the air receiver, and a non-zero rate of change in the opposite direction when the pressure of air within the air receiver exceeds the manually selected pressure. In a preferred embodiment, the slope of the relationship between the error signal and the output of the target rate of change generator becomes greater as the error signal departs from zero in a first direction and also becomes greater as the error signal departs from zero in the opposite direction. The appropriate transfer function for the target rate of change generator can be implemented easily in a programmed logic array.

In the drilling rig, an air conduit is arranged to deliver air from the air receiver, through the drill head, to the drill pipe, and a blow-down valve is preferably connected to the conduit for relieving air pressure in the conduit. In the case in which a blow-down valve is used, the electronic controller also preferably has an output, connected to operate the blow-down valve, for opening the blow-down valve when the difference between the manually selected pressure and the pressure of air within the air receiver, as sensed by the sensor, exceeds a first predetermined value. The output of the controller also preferably closes the blow-down valve when the difference between the manually selected pressure and the pressure of air within the air receiver as sensed by the sensor falls below a predetermined second value less than the first predetermined value.

In a preferred embodiment of the invention, a selector is connected to the electronic controller, for closing the throttling valve at the intake of the compressor substantially completely, thereby unloading the compressor. The electronic controller also preferably has an output, connected to operate the blow-down valve, for opening the blow-down valve when the throttling valve at the intake of the compressor is closed substantially completely by operation of the selector.

A temperature sensor can be connected to the air outlet port of the compressor for sensing the temperature of the air discharged by the compressor. The temperature sensor is connected to deliver a signal to the electronic controller, and the controller is responsive to the signal from the temperature sensor to establish limits on aperture of the compressor intake throttling valve when the sensed temperature is in a limited range between a first predetermined value and a second, higher, predetermined value, the aperture being increasingly limited as the temperature of the discharged air increases within the limited range. Preferably, the electronic controller causes the compressor intake throttling valve to close substantially completely when the temperature of the air discharged by the compressor reaches the second, higher, predetermined value. The electronic controller also preferably opens the blow-down valve and shuts down the engine when the temperature of the air discharged by the compressor reaches the second predetermined value.

The electronic controller can also be responsive to an engine load sensor for decreasing a limit on the variable aperture of the compressor intake throttling valve at a predetermined rate when the engine load exceeds a first predetermined load, and for increasing the limit on the variable aperture of the valve at a predetermined rate when the engine load is less than a second predetermined load less than the first predetermined load.

The electronic controller can also be responsive to an engine oil pressure sensor for closing the compressor intake throttling valve substantially completely when the engine oil pressure falls below a predetermined value.

To avoid unsafe overpressure conditions, the electronic controller also preferably causes the compressor intake throttling valve to close substantially completely when the pressure of air within the air receiver exceeds the manually selected pressure by a predetermined amount, for example, a difference of 10 psi. The controller preferably also opens the blow-down valve at the same time.

The electronic controller sets the outlet pressure of the compressor as well as the intake volume of the compressor.

Depending on how it is configured, the invention can afford one or more of the following advantages over a conventional pneumatically operated drilling rig compressor system.

First, the system can be readily switched to a compressor unload mode to aid starting of the engine.

Second, during drilling, an operator can readily select a desired pressure, lower than the capacity of the compressor, as the maximum operating pressure.

Third, the compressor output can be matched to borehole flow within the capacity range of the compressor and the preset maximum pressure so as to minimize unloading of the compressor.

Fourth, the pressure and the volume of the compressed air flowing into the borehole can be readily adjusted in order to drill the borehole as rapidly as possible.

Fifth, unlike a pneumatically controlled compressor, which unloads each time the air receiver pressure reaches a preset level, the compressor in accordance with the invention only unloads during start-up and when certain special conditions arise, such as excessive temperature in the compressor discharge, or overpressure. By minimizing compressor unloading, the control system reduces fuel consumption.

Sixth, the control system shuts down the engine when an overtemperature condition is reached at the compressor discharge. However, the system reduces the occurrence of shut-down due to an overtemperature condition by derating the compressor gradually as the discharge temperature approaches the critical level at which shut-down would occur.

Seventh, the system also derates the compressor when the engine load approaches 100%, allowing the engine to continue to operate at its rated speed without stalling.

Eighth, the ability to adjust the air compressor volume results in improved borehole quality and greater drilling productivity.

Ninth, the system protects both the air compressor and the engine, and maintains the engine speed at a nearly constant level so that the hydraulic systems can operate smoothly.

Tenth, the compressor control system achieves superior drilling performance, in terms of the amount of hole drilled per hour, and also achieves improved fuel economy in terms of gallons of fuel consumed per foot of hole drilled.

Finally, the invention provides increased reliability, since, unlike pneumatic controls, which are subject to freezing of condensate and contamination, the system of the invention can operate reliably in any climate.

Other details and advantages of the invention will be apparent from the following detailed description when read in conjunction with the drawings.

DETAILED DESCRIPTION OF THE PREFERRED EMBODIMENT

Figure 1:
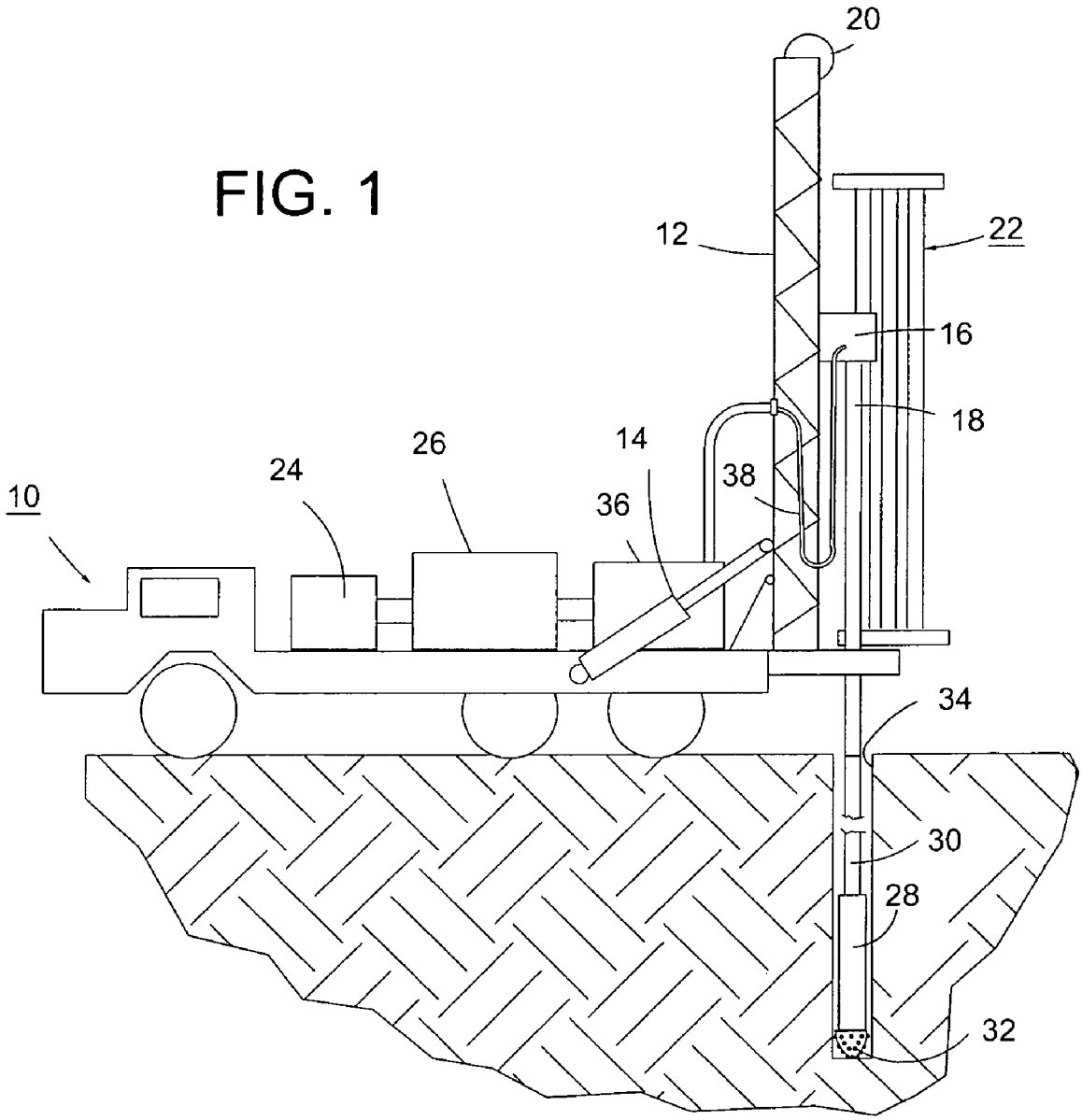
FIG. 1 is a schematic diagram of a drilling rig incorporating a compressor system in accordance with the invention.

As shown in FIG. 1, a typical drilling rig is self-propelled, being incorporated onto a vehicle 10. The drilling rig includes an elongated mast 12, which is hinged to the vehicle, and tiltable by one or more hydraulic actuators 14 from a horizontal condition for transport, to a vertical condition, as shown, for drilling. The mast can also be held in an oblique condition for angle drilling.

A drill head 16, for rotating a drill pipe 18, is guided for longitudinal movement along the mast, and a hoist 20 is provided for controlling movement of the drill head. The drill pipe is made up by connecting lengths of pipe supplied from a carousel 22 by means of a transfer mechanism (not shown). The hydraulic actuators for tilting the mast, the drill head, the hoist, the transfer mechanism, and various other components of the drilling rig, are operated by hydraulic fluid supplied by a set 24 of hydraulic pumps, operated by a Diesel engine 26.

A pneumatic hammer 28 is optionally provided at the lower end of a lowermost section 30 of drill pipe 18, and a cutting bit 32 is connected to the lower end of the hammer 28. The cutting bit can be any one of various types of earth- or rock-drilling bits, such as a tri-cone bit, or a bit having diamond or carbide inserts.

Compressed air is supplied through the drill pipe to eject cuttings from the borehole 34, and to operate the pneumatic hammer, if one is used. The air is supplied to the upper end of the drill pipe, from a compressor 36, through a flexible conduit 38. The compressor 36 is driven by engine 26, the same engine that drives the hydraulic pumps 24. Driving both the hydraulic pumps and the compressor from a single engine, eliminates the need for a separate engine, reduces the overall weight of the drilling rig, and achieves efficient operation.

Figure 2:
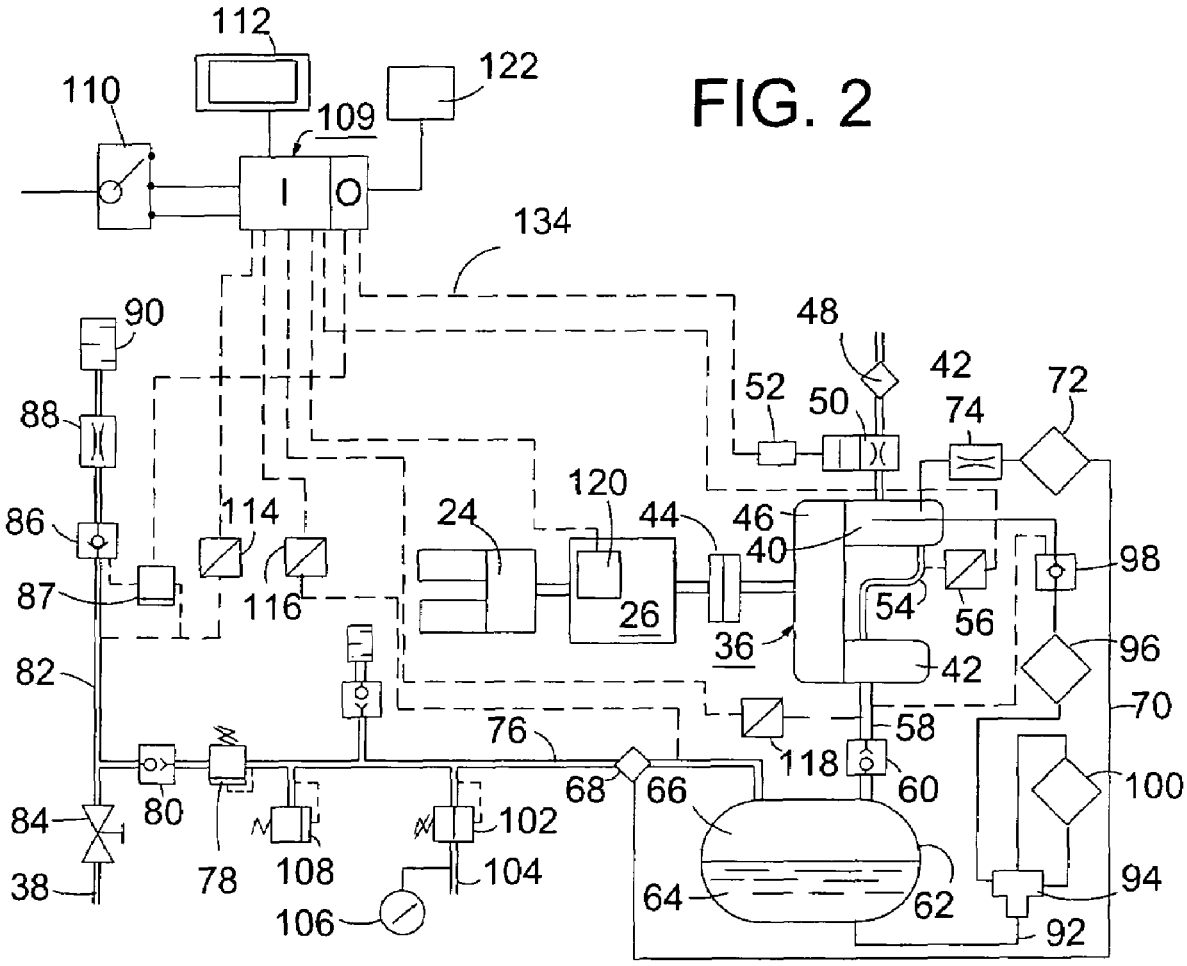
FIG. 2 is a schematic diagram of the compressor system.

As shown in FIG. 2, the preferred compressor 36 is a two-stage screw compressor having a first stage 40, and a second stage 42, both driven by engine 26 through a clutch 44 and a gearbox 46. The first stage 40 takes in atmospheric air through an air cleaner 48, and an inlet throttle valve 50 controlled by an electrically or hydraulically operated actuator 52, which responds to an electrical command and incorporates feedback. The actuator can be a linear actuator or a rotary actuator, and is preferably a voltage-responsive actuator in which the position of the output shaft corresponds directly to an applied D.C. voltage. A Model 750 ELA electric linear actuator, available from P-Q Controls, Inc. at 95 Dolphin road, Bristol, Conn. 06010, U.S.A. is suitable. The valve 50 is typically a "butterfly" valve. The air compressed by the first stage 40 is delivered to the second stage through a conduit 54, and an interstage pressure transducer 56 is connected to the conduit 54.

The compressed air discharged from the second stage is delivered, though conduit 58 and a discharge check valve 60, to a receiver 62, which is partially filed with oil 64, leaving an internal space 66 above the oil surface for accumulation of compressed air.

Compressed air is discharged from the receiver 62 through an oil separator 68, which returns oil through a drain line 70, a strainer 72, and an orifice 74, to the first stage 40 of the compressor. After passing through the oil separator 68, the air flows through conduit 76, a minimum pressure valve 78 and a check valve 80, to a conduit 82, which is connected, through a valve 84 and conduit 38 (see also FIG. 1) to the drill pipe. Valve 78 is mechanically set to open only when the air pressure in conduit 76 is at or above a preset level, for example, 175 psi.

Conduit 82 is provided with a "blowdown" valve 86, which is controlled through a pilot valve 87 to set a maximum pressure for the air in conduit 82. An orifice 88 and a muffler 90 are provided in series on the outlet side of the blowdown valve.

The receiver 62 is connected through a line 92, and a thermostatic valve 94, an oil filter 96, and an oil stop valve 98, to the first stage 40 of the compressor. The thermostatic valve is provided with an oil cooler 100, which becomes operative to cool the oil when the oil temperature exceeds a predetermined temperature level. When the oil temperature becomes too high, the oil, instead of flowing directly through the thermostatic valve to the oil filter 96, flows through the oil cooler 100, and then back through the thermostatic valve to the oil filter 96. The oil stop valve 98 is connected to the compressor discharge conduit 58.

The oil stop valve prevents backflow of compressor oil into the compressor after the compressor is shut down. Without the oil stop valve, the air pressure in the air receiver would cause the compressor oil to flow backwards, flooding the compressor with oil, which would eventually backflow to the intake air cleaner and flow out from the air cleaner into the environment. The connection between the oil stop valve and the compressor discharge is a control line that opens the oil stop valve when the air compressor is in operation and closes the oil stop valve when the compressor is not in operation.

A pressure-reducing valve 102 is connected to conduit 76 to provide auxiliary air at outlet 104 for uses other than operation of the pneumatic hammer and discharge of cuttings from the borehole. An air pressure gauge 106 is provided at outlet 104. A system safety valve 108 is also connected to conduit 76 to discharge air if the pressure in conduit 76 exceeds a preset upper limit.

The electrical control for the compressor preferably consists of one or more programmed logic arrays within control module 109. A selector switch 110, associated with the control module 109, allows an operator to select "low" compressor outlet pressure or "high" compressor outlet pressure, and also "compressor unloaded," in which throttle valve 50 is closed, or almost completely closed, shutting down the flow of air to the compressor intake. In an alternative embodiment (not shown) the selector switch can enable the operator to select one or more intermediate compressor outlet pressures.

A human-machine interface (HMI) 112, associated with the control module, displays data concerning compressor operation on a monitor screen, and allows the operator to make control selections (in addition to the selections made through switch 110) by touching control buttons. The functions of the buttons can be identified by graphics printed on or adjacent to the buttons. Alternatively, the functions of the buttons can be displayed on the monitor screen.

In addition to the inputs from the selector switch 110 and the HMI, the control module receives inputs from several other sources. One source is a line pressure transducer 114, which senses air pressure in conduit 82. A second source is a sump pressure transducer 116, which senses air pressure in receiver 62. These transducers are typically pressure-to-voltage transducers. A third source is temperature transducer 118, which senses the temperature of the air at the compressor discharge conduit 58. A fourth source is interstage pressure transducer 56. A fifth source is an electronic control module (ECM) 120 associated with engine 26.

The engine ECM (electronic control module) is the primary control for the engine, controlling fuel rate, timing and engine safety features. Following the SAE J1939 protocol, the engine ECM also provides essential engine information such as engine RPM, oil pressure, coolant temperature, percent engine load relating to horsepower, engine faults and engine operating hours, etc.

The control module 109 has three outputs. A first output is connected to the pilot valve 87, which controls "blowdown" valve 86, to set a maximum pressure for the air in conduit 82. A second output is a variable D.C. voltage which controls actuator 52 to set the aperture of throttle valve 50 at the compressor intake. A third output is connected to an emergency stop relay 122, which shuts down engine 26 in the event of an emergency condition, such as high compressor discharge temperature, or activation of a manual emergency stop switch. The emergency stop relay, which is controlled by the drill rig PLC, stops the engine by grounding a pin in the engine ECM, which cuts off the fuel supply to the engine.

To start the compressor, the selector switch 110 is manually set to the "unload" position, in which it causes the control module 109 to send a command to the actuator 52, causing the compressor intake throttle valve 50 to close, or to become nearly closed. Closing the intake to the compressor greatly reduces the load on the engine, and is important especially when starting the engine in cold weather. After the engine is started, when compressed air is needed, the operator can set the selector switch 110 to "Low Pressure" or "High Pressure." The low pressure is fixed, typically, at a pressure equal to or greater than the setting of the minimum pressure valve 78 so as to maintain the circulation of oil through the compressor. The high pressure is set through the HMI to unload the compressor at any set pressure up to the maximum rating of the compressor, typically 350-500 psi. The operator can also use the HMI to adjust the intake volume of the compressor.

Figure 3:
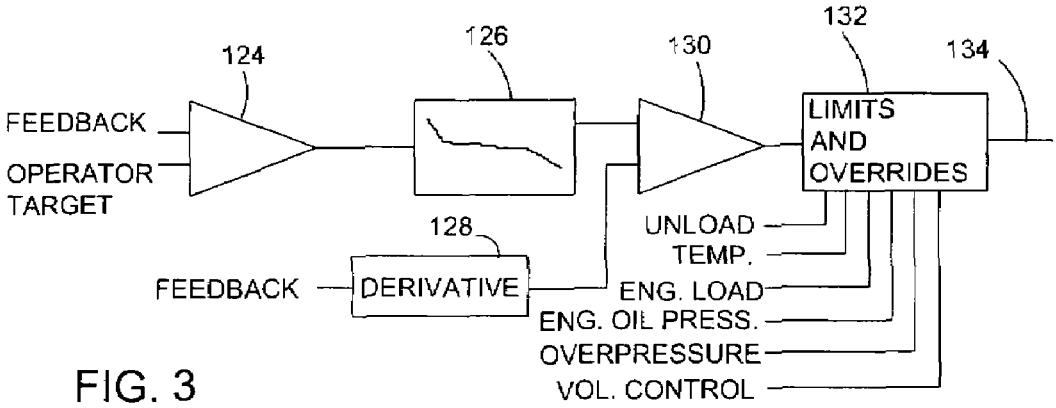
FIG. 3 is a flow diagram showing the manner in which the compressor intake throttle valve is controlled.

The operation of the control module is depicted by way of a flow diagram in FIG. 3. The receiver pressure, as sensed by sensor 116 (FIG. 2), is designated "feedback" in FIG. 3, and compared by a difference amplifier 124 with a target pressure selected by the operator through interface 112, or, in the case where compressor "unload" is selected, through selector switch 110. An error signal, corresponding to the difference between the sensed receiver pressure and the selected target pressure, is processed by a target generator 126, which produces a unique output level for each error signal level at its input, following a non-linear transfer function. The target generator establishes a target rate of pressure change at its output as a set point. The curve shown on the target generator depicts the transfer function, i.e., the relationship between its input (the abscissa) and its output (the ordinate). A zero error signal corresponds to the middle portion of the curve, and results in a zero set point for the target rate of pressure change. If the sensed pressure is far above the selected target pressure (corresponding to the left-hand part of the curve), the value of the set point for the target rate of change will be large in one direction, and if the sensed pressure is far below the selected target pressure (corresponding to the right-hand part of the curve), the value of the set point for the target rate of change will be large in the opposite direction.

A signal corresponding to the time rate of change of the pressure signal delivered by sensor 116 is produced in the control module by a derivative block 128, and fed, along with the target rate of change, to a proportional-integral (PI) amplifier 130, which compares the target rate of change with the actual rate of change as determined by the derivative block 128. A control signal corresponding to the output of the amplifier 130, subject to various limits and overrides, established by inputs to block 132, is delivered through control path 134 (See FIGS. 2 and 3) to the actuator 52, which controls the intake throttle valve 50 of the compressor. The control depicted in FIG. 3 is therefore a proportional-integral-derivative (PID) control loop, in which the intake throttle valve operates rapidly if the error signal (the difference between the operator-established target and the sensed receiver pressure) is large, but operates more slowly if the error signal is small. Integral gain is necessary to be preemptive in opening and closing the intake throttle valve to avoid undesirable results, i.e., overshooting the maximum pressure target and popping the receiver tank's safety valve.

Figure 4:
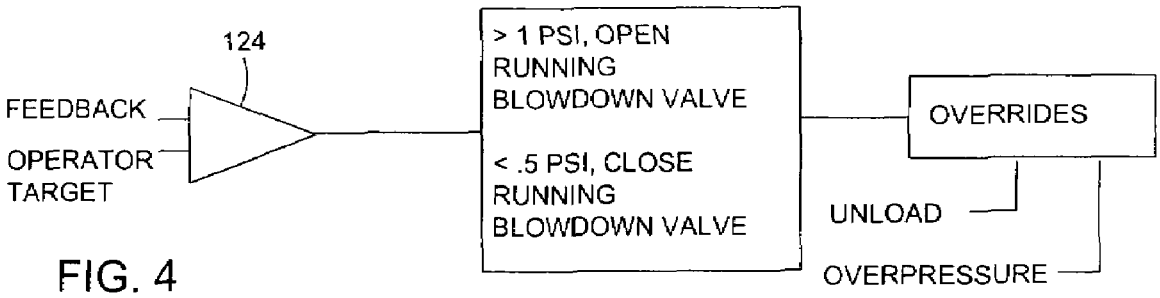
FIG. 4 is a flow diagram showing the manner in which a running blowdown valve in the compressor system's main air discharge conduit is controlled.

At the same time, as depicted in FIG. 4, the error signal from difference amplifier 124 is used to control the pilot valve 87, which in turn controls the blow-down valve 86, subject to several overrides. If the error exceeds 1 psi, the blow-down valve 86 is opened, and if the error signal falls below 0.5 psi, the blowdown valve 86 is closed.

Figure 5:
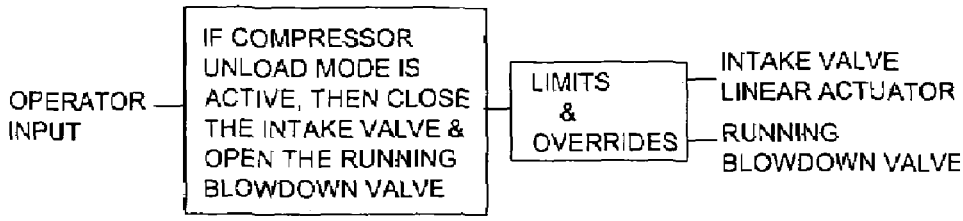
FIGS. 5-10 are flow diagrams illustrating the operation of various limits and overrides in FIGS. 3 and 4.

A first override is an "unload" override, produced when the manual selector switch 110 is set to the "unload" position. The operation of this override is depicted FIG. 5. If the compressor unload mode is selected, the intake throttle valve is closed. At the same time, the running blowdown valve 86 is opened.

Figure 6:
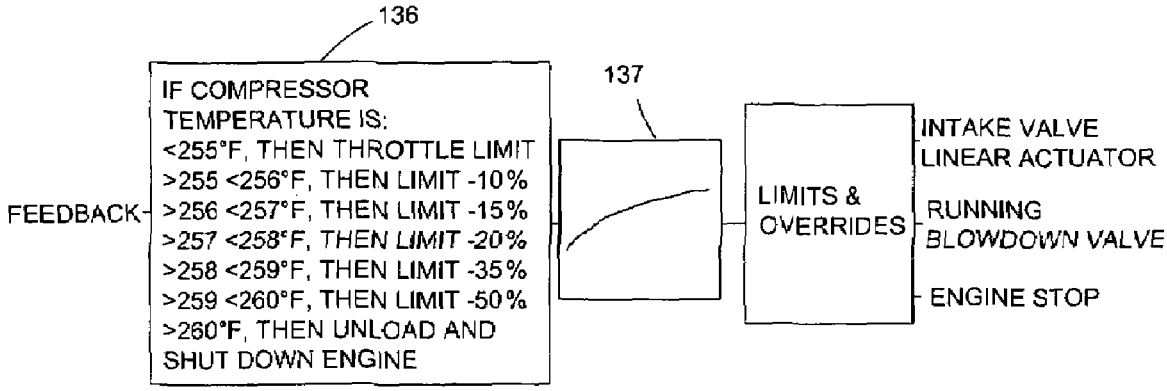

The second override is a "compressor temperature" override. FIG. 6 represents the logic which overrides the PID control loop if the PID control loop is calling for a higher actuator control voltage than a predetermined set of control voltages corresponding to a pre-established set of temperature limits. The temperature transducer 118 (FIG. 2) delivers a signal corresponding to the temperature of the air at the compressor outlet to a block 136 in the control module 109. The block establishes throttle limits for temperatures in the range from 255° F. to 260° F. As the limits are exceeded, corrective action is taken by causing actuator 52 to adjust throttle valve 50 to change the volume of air being compressed. If the compressor temperature is 255° F. or less, the compressor intake throttle valve is allowed to open the throttle to the limit determined by operator input through the human-machine interface 112. However, if the compressor temperature rises above 255° F., block 136 establishes limits on the degree to which the compressor intake throttle valve can be opened. For example, in the preferred embodiment, if the compressor outlet temperature is greater than 255° F. but less than 256° F., the throttle limit position is reduced by 10%, that is, the air compressor volume is de-rated by 10%. If the temperature is greater than 256° F., but less than 257° F., the throttle limit position is reduced by 15%. If the temperature is greater than 257° F., but less than 258° F., the throttle limit position is reduced by 20%. If the temperature is greater than 258° F., but less than 259° F., the throttle limit position is reduced by 35%. If the temperature is greater than 259° F., but less than 260° F., the throttle limit position is reduced by 50%. Reduction in the volume of air available at the intake of the compressor during an overtemperature condition reduces the load on the compressor, which reduces the heat generated as a result of compression. Block 137 in FIG. 6 represents linearization, in the control module 109, of the relationship between compressor intake volume (in CFM) and the voltage output delivered by control module 109 to the linear actuator, the position of which has a nearly linear relationship to its input voltage.

If the compressor outlet temperature becomes equal to or greater than 260° F., an override condition is generated, in which the temperature sensor overrides the PID control of FIG. 3 and the running blowdown valve control of FIG. 4, and the actuator 52 is controlled directly to close the compressor intake throttle valve 50 and at the same time open the running blow down valve 86. This override condition also activates emergency stop relay 122 (FIG. 2), causing the engine 26 to stop.

Figure 7:
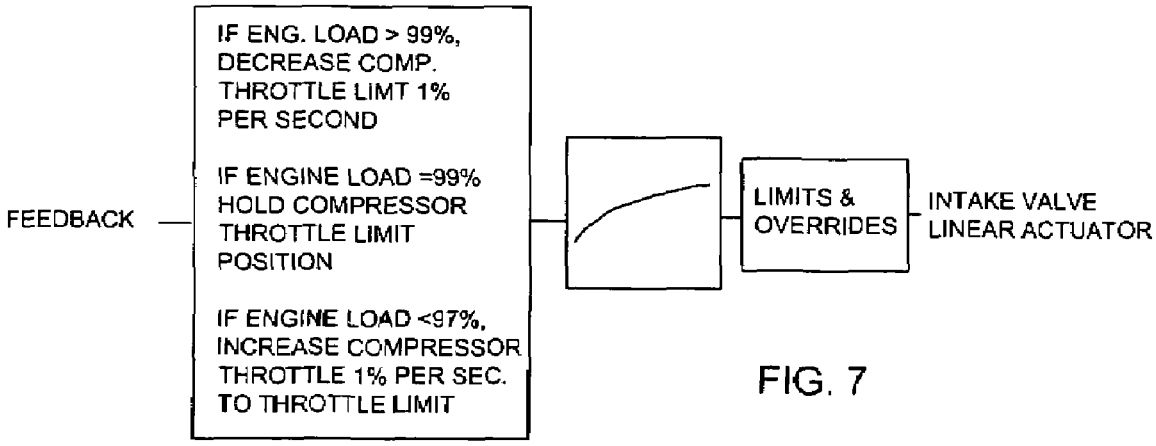

The third override is an "engine load" override. FIG. 7 represents the logic by which the PID control loop is overridden if the engine load exceeds 99% of its rated load. As depicted in FIG. 7, the control module 109 monitors the percent of engine load as measured by the ECM 120 (FIG. 2). If the engine load is greater than 99% of rated horsepower, the control module reduces the compressor intake throttle limit that has been set by the HMI. The throttle limit is reduced until the engine load feedback from the electronic control module 120 is equal to 99%. At 99% of engine load, the control system holds the current compressor throttle limit. When the engine load is less than 97%, the control system increases the compressor throttle limit from its current position by increasing the control voltage delivered to the actuator 52.

Figure 8:
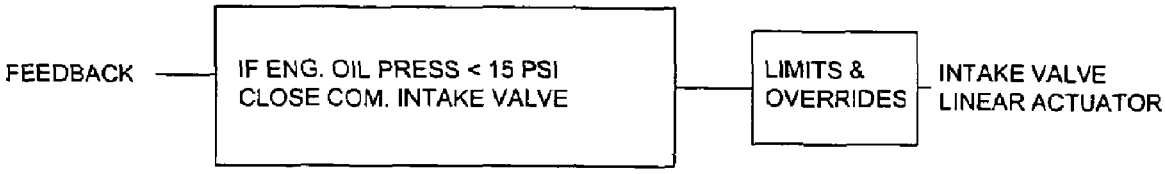

As depicted in FIG. 8, the control module also monitors engine oil pressure, through a signal transmitted by the electronic control module 120. An override condition is generated if the engine oil pressure drops below 15 psi. If the oil pressure is less than 15 psi, the control module overrides the PID control of FIG. 3 and the running blowdown valve control of FIG. 4, directly controlling the actuator so that the compressor intake control valve 50 is closed, and at the same time operating the pilot valve 87, causing the running blow-down valve 86 to open.

Figure 9:
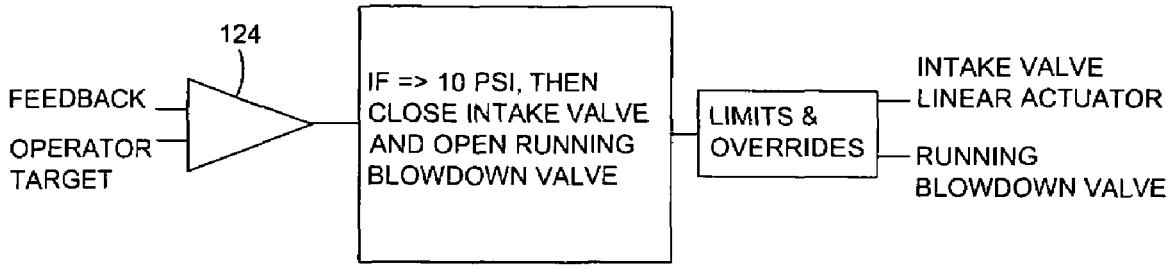

FIG. 9 depicts a safety override in which the error signal at the output of summing amplifier 124, which corresponds to the difference between the actual receiver pressure and the operator-established target pressure is monitored. If the error reaches or exceeds a predetermined value, for example 10 psi, a safety override condition is generated in which the compressor intake valve 50 is closed by actuator 52, and the running blowdown valve 86 is opened by operation of its pilot valve 87.

Figure 10:
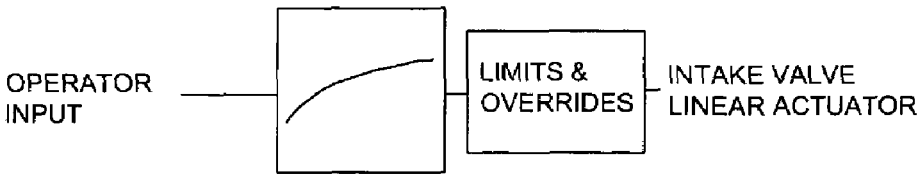

FIG. 10 depicts the logic by which the operator, by using the human-machine interface 112, can set the volume of the compressor to any desired value between, for example, 30% and 100% of the compressor's rating. The control module receives the operator input, and, establishes an upper limit on the output voltage for delivery to the actuator 52, thereby overriding the PID control loop.

If a limit or override condition is in effect that is reducing the volume flow of air, the control system continues to monitor pressure. If the pressure reaches the target pressure, the PID control loop decreases the voltage supplied to the actuator to match the supply to the demand, or unloads the compressor and opens the running blowdown valve.

Various modifications can be made to the drilling rig as described. For example, the control module, while preferably implemented by programmed logic controls, can be implemented using discrete logic components, or can be microprocessor-based. The human-machine interface can take any of several forms, using a touch-screen, simple toggle switches, "potentiometers" and similar control devices. One or more of the various override and limit features can be eliminated, and other overrides and limits can be added, depending on the needs of the drilling rig operator. In addition, although the compressor throttle intake valve actuator is described as an electrical linear actuator, various other forms of actuators can be used, for example, an electrically operated rotary actuator or a hydraulic or pneumatic actuator responsive to electrical commands derived from the control module.

Still other modifications can be made to the apparatus and method described above without departing from the scope of the invention as defined in the following claims.

What is claimed is:

1. An earth drilling rig having components including a drill head for rotating a hollow drill pipe, an elongated, tiltable, mast for supporting the drill head and a hollow drill pipe supported by, and rotatable by, the drill head, and a hoist for moving the drill head longitudinally along the mast, the drilling rig also comprising:

a hydraulic pump mechanism for supplying hydraulic fluid under pressure for driving at least one of said components of the drilling rig;

an air receiver for storing air under pressure, said air receiver being connected to the drill head for delivery of compressed air to the hollow drill pipe supported by the drill head;

an air compressor, having an air inlet port, and an air outlet port, for supplying air, through the outlet port, to the air receiver, an engine arranged to drive both the air compressor and the hydraulic pump;

a valve having a variable aperture, the valve being arranged to throttle the flow of air through the inlet port of the compressor;

an actuator, connected to the valve, for opening and closing of the aperture of the valve, the actuator being capable of maintaining each of a plurality of discrete valve apertures between limits of a range of valve apertures;

a sensor responsive to the pressure of air within the air receiver; and an electronic controller for operating said actuator, said controller having a manually selectable input for selecting a compressor outlet pressure, and a feedback input, the feedback input being responsive to said sensor, for controlling said valve through said actuator and thereby maintaining the compressor outlet pressure at a level corresponding to the pressure selected through said manually selectable input;

in which said electronic controller comprises a first comparison device, responsive to said manually selectable input and said feedback input, for producing an error signal corresponding to the difference between the manually selected pressure and the pressure of air within the air receiver as sensed by said sensor, a target rate of change generator, responsive to the error signal, for generating an output having a predetermined relationship to the magnitude of the error signal, a differentiator, responsive to the sensor, for producing a signal proportional to the time rate of change of the air pressure in the receiver, and a second comparison device, responsive to said output of the target rate of change generator and the signal produced by the differentiator, for producing a control output, the actuator being responsive to said control output of the second comparison device.

2. The earth drilling rig according to claim 1, in which the target rate of change generator produces an output corresponding to a zero rate of change of air pressure when the error signal corresponds to a zero difference between the manually selected pressure and the pressure of air within the air receiver, a non-zero rate of change in a first direction when the manually selected pressure exceeds the pressure of air within the air receiver, and a non-zero rate of change in the opposite direction when the pressure of air within the air receiver exceeds the manually selected pressure.

3. The earth drilling rig according to claim 2, in which the slope of the relationship between the error signal and the output of the target rate of change generator becomes greater as the error signal departs from zero in a first direction and also becomes greater as the error signal departs from zero in the opposite direction.

4. An earth drilling rig having components including a drill head for rotating a hollow drill pipe, an elongated, tiltable, mast for supporting the drill head and a hollow drill pipe supported by, and rotatable by, the drill head, and a hoist for moving the drill head longitudinally along the mast, the drilling rig also comprising:

a hydraulic pump mechanism for supplying hydraulic fluid under pressure for driving at least one of said components of the drilling rig;

an air receiver for storing air under pressure, said air receiver being connected to the drill head for delivery of compressed air to the hollow drill pipe supported by the drill head;

an air compressor, having an air inlet port, and an air outlet port, for supplying air, through the outlet port, to the air receiver, an engine arranged to drive both the air compressor and the hydraulic pump;

a valve having a variable aperture, the valve being arranged to throttle the flow of air through the inlet port of the compressor;

an actuator, connected to the valve, for opening and closing of the aperture of the valve, the actuator being capable of maintaining each of a plurality of discrete valve apertures between limits of a range of valve apertures;

a sensor responsive to the pressure of air within the air receiver; and an electronic controller for operating said actuator, said controller having a manually selectable input for selecting a compressor outlet pressure, and a feedback input, the feedback input being responsive to said sensor, for controlling said valve through said actuator and thereby maintaining the compressor outlet pressure at a level corresponding to the pressure selected through said manually selectable input;

the drill rig including a temperature sensor, connected to the air outlet port of the compressor, for sensing the temperature of the air discharged by the compressor, said sensor being connected to deliver a signal to the electronic controller, and said controller being responsive to the signal from the temperature sensor to establish limits on aperture of said valve when the sensed temperature is in a range between a first predetermined value and a second, higher, predetermined value, the aperture being increasingly limited as the temperature of the discharged air increases within said range.

5. The earth drilling rig according to claim 4, in which said electronic controller causes said valve to close substantially completely when the temperature of the air discharged by the compressor reaches said second predetermined value.

6. The earth drilling rig according to claim 4, including an air conduit arranged to deliver air from the air receiver, through the drill head, to the drill pipe, and having a blow-down valve connected to said conduit for relieving air pressure in said conduit, the electronic controller also having an output, connected to operate the blow-down valve, for opening the blow-down valve when the temperature of the air discharged by the compressor reaches said second predetermined value.

7. The earth drilling rig according to claim 4, in which said electronic controller includes an output connected to the engine, for shutting down operation of the engine when the temperature of the air discharged by the compressor reaches said second predetermined value.

8. An earth drilling rig having components including a drill head for rotating a hollow drill pipe, an elongated, tiltable, mast for supporting the drill head and a hollow drill pipe supported by, and rotatable by, the drill head, and a hoist for moving the drill head longitudinally along the mast, the drilling rig also comprising:

a hydraulic pump mechanism for supplying hydraulic fluid under pressure for driving at least one of said components of the drilling rig;

an air receiver for storing air under pressure, said air receiver being connected to the drill head for delivery of compressed air to the hollow drill pipe supported by the drill head;

an air compressor, having an air inlet port, and an air outlet port, for supplying air, through the outlet port, to the air receiver, an engine arranged to drive both the air compressor and the hydraulic pump;

a valve having a variable aperture, the valve being arranged to throttle the flow of air through the inlet port of the compressor;

an actuator, connected to the valve, for opening and closing of the aperture of the valve, the actuator being capable of maintaining each of a plurality of discrete valve apertures between limits of a range of valve apertures;

a sensor responsive to the pressure of air within the air receiver; and an electronic controller for operating said actuator, said controller having a manually selectable input for selecting a compressor outlet pressure, and a feedback input, the feedback input being responsive to said sensor, for controlling said valve through said actuator and thereby maintaining the compressor outlet pressure at a level corresponding to the pressure selected through said manually selectable input;

the drill rig including an engine load sensor for sensing the load on the engine, and in which the electronic controller is responsive to the engine load sensor for decreasing a limit on the variable aperture of said valve at a predetermined rate when the engine load exceeds a first predetermined load, and for increasing the limit on the variable aperture of the valve at a predetermined rate when the engine load is less than a second predetermined load less than said first predetermined load.

9. An earth drilling rig having components including a drill head for rotating a hollow drill pipe, an elongated, tiltable, mast for supporting the drill head and a hollow drill pipe supported by, and rotatable by, the drill head, and a hoist for moving the drill head longitudinally along the mast, the drilling rig also comprising:

a hydraulic pump mechanism for supplying hydraulic fluid under pressure for driving at least one of said components of the drilling rig;

an air receiver for storing air under pressure, said air receiver being connected to the drill head for delivery of compressed air to the hollow drill pipe supported by the drill head;

an air compressor, having an air inlet port, and an air outlet port, for supplying air, through the outlet port, to the air receiver, an engine arranged to drive both the air compressor and the hydraulic pump;

a valve having a variable aperture, the valve being arranged to throttle the flow of air through the inlet port of the compressor;

an actuator, connected to the valve, for opening and closing of the aperture of the valve, the actuator being capable of maintaining each of a plurality of discrete valve apertures between limits of a range of valve apertures;

a sensor responsive to the pressure of air within the air receiver; and an electronic controller for operating said actuator, said controller having a manually selectable input for selecting a compressor outlet pressure, and a feedback input, the feedback input being responsive to said sensor, for controlling said valve through said actuator and thereby maintaining the compressor outlet pressure at a level corresponding to the pressure selected through said manually selectable input;

the drill rig, including an engine oil pressure sensor for sensing lubricating oil pressure in said engine, and in which the electronic controller is responsive to said engine oil pressure sensor for closing said valve substantially completely when the engine oil pressure falls below a predetermined value.

10. An earth drilling rig having components including a drill head for rotating a hollow drill pipe, an elongated, tiltable, mast for supporting the drill head and a hollow drill pipe supported by, and rotatable by, the drill head, and a hoist for moving the drill head longitudinally along the mast, the drilling rig also comprising:

a hydraulic pump mechanism for supplying hydraulic fluid under pressure for driving at least one of said components of the drilling rig;

an air receiver for storing air under pressure, said air receiver being connected to the drill head for delivery of compressed air to the hollow drill pipe supported by the drill head;

an air compressor, having an air inlet port, and an air outlet port, for supplying air, through the outlet port, to the air receiver, an engine arranged to drive both the air compressor and the hydraulic pump;

a valve having a variable aperture, the valve being arranged to throttle the flow of air through the inlet port of the compressor;

an actuator, connected to the valve, for opening and closing of the aperture of the valve, the actuator being capable of maintaining each of a plurality of discrete valve apertures between limits of a range of valve apertures;

a sensor responsive to the pressure of air within the air receiver; and an electronic controller for operating said actuator, said controller having a manually selectable input for selecting a compressor outlet pressure from a range of choices of compressor outlet pressures, and a feedback input, the feedback input being connected to said sensor, said electronic controller being responsive to said manually selectable input and said feedback input, and controlling said value through said actuator and thereby maintaining the compressor outlet pressure at a level corresponding to the outlet pressure selected through said manually selectable input.

* * * * *